US006955360B2

(12) United States Patent
Krivulin

(10) Patent No.: US 6,955,360 B2
(45) Date of Patent: Oct. 18, 2005

(54) IN-LINE ROLLER SKATE BRAKING MECHANISM

(76) Inventor: Arkadiy Krivulin, 1443 N. Fuller Ave. #319, Los Angeles, CA (US) 90046

( * ) Notice: Subject to any disclaimer, the term of this patent is extended or adjusted under 35 U.S.C. 154(b) by 173 days.

(21) Appl. No.: 10/642,380

(22) Filed: Aug. 14, 2003

(65) Prior Publication Data

US 2005/0035563 A1 Feb. 17, 2005

(51) Int. Cl.[7] ..... A63C 17/14
(52) U.S. Cl. ..... 280/11.206; 280/11.211
(58) Field of Search ..... 280/11.204, 11.206, 280/11.207, 11.208, 11.211, 11.215, 11.216, 280/11.217

(56) References Cited

U.S. PATENT DOCUMENTS

| | | | | |
|---|---|---|---|---|
| 5,232,231 A | * | 8/1993 | Carlsmith | 280/11.215 |
| 5,280,930 A | | 1/1994 | Smathers et al. | 280/11.212 |
| 5,411,276 A | | 5/1995 | Moldenhauer | 280/11.212 |
| 5,468,004 A | | 11/1995 | Olson et al. | 280/11.212 |
| 5,566,958 A | | 10/1996 | Sinelnikov et al. | 280/11.231 |
| 5,716,059 A | * | 2/1998 | Thomas | 280/11.208 |
| 5,865,445 A | * | 2/1999 | Svensson et al. | 280/11.214 |
| 6,039,330 A | * | 3/2000 | Hoskin | 280/11.215 |
| 6,254,109 B1 | | 7/2001 | Horton | 280/11.214 |
| 2004/0021278 A1 | * | 2/2004 | Lyden | 280/11.31 |

FOREIGN PATENT DOCUMENTS

| | | | | |
|---|---|---|---|---|
| DE | 198 47 157 | * | 4/2000 | A63C 17/14 |
| JP | 10-71224 | * | 3/1998 | A63C 17/14 |

* cited by examiner

*Primary Examiner*—Frank Vanaman
(74) *Attorney, Agent, or Firm*—Sheldon & Mak; Denton L. Anderson

(57) ABSTRACT

A braking mechanism for a skate, such as an in-line roller skate, has at least one braking wheel disposed transverse to the skate boot. The braking wheel operates a piston which displaces liquid from a piston housing when the piston is caused to travel within the piston housing by the rotation of the braking wheel. The piston and the piston housing are configured such that an increasing resistance is applied to the rotation of the braking wheel as the piston travels within the piston housing. Thus, when the skate boot is turned transverse to the direction of the skater and the angle of the boot is adjusted to cause the braking wheel to rotate, the increased resistance to the rotation of the braking wheel as the piston moves within the piston housing acts to slow the skater. When the piston fully traverses the piston housing, the rotation of the braking wheel is terminated and the skater comes to a stop.

18 Claims, 9 Drawing Sheets

IN-LINE ROLLER SKATE BRAKING MECHANISM

FIELD OF THE INVENTION

This invention relates generally to skates and, more particularly, to braking mechanisms for skates, especially for in-line roller skates.

BACKGROUND OF THE INVENTION

In-line roller skates have become very popular. A problem persists with respect to in-line roller skates, however, regarding the inability of an in-line roller skate to stop efficiently as can an ice skate. In-line roller skates cannot stop quickly and efficiently like ice skates, because in-line roller skates cannot brake by turning one or, preferably, both of the skates transverse to the direction of travel.

Accordingly, there is a need for a braking mechanism for in-line roller skates which avoids this problem in the prior art.

SUMMARY OF THE INVENTION

The invention is a braking system for a skate, such as an in-line roller skate. Typically, such a skate has a base skating surface with a base skating surface longitudinal axis. The braking mechanism comprises (a) at least one braking wheel disposed above the base skating surface, the at least one braking wheel being rotatable about a braking wheel axis disposed in a vertical plane, the vertical plane intersecting the base skating surface longitudinal axis at an angle of between about −20° and about +20°; (b) a piston housing having piston housing side walls, a first piston housing section proximal to a first piston housing end and a second piston housing section distal to the first piston housing end, the first piston housing section defining a plurality of first piston housing section side wall apertures, the first piston housing section side wall apertures being disposed at a plurality of different distances from the piston housing first end, the second piston housing section comprising one or more second piston housing section side wall apertures; (c) a piston disposed within the piston housing, the piston having a first end and a second end, the first end comprising an internal piston flow channel and a slide valve disposed in the first end of the piston for controlling the flow of liquid from the piston flow channel to the first piston housing section, the piston further comprising one or more piston inlet channels for allowing the flow of liquid into the piston flow channel from the second piston housing section, the piston being mechanically connected to the at least one braking wheel such that the rotation of the at least one braking wheel moves the piston within the piston housing between (i) a first piston position wherein the piston is distal from the first piston housing end and wherein the piston is not adjacent to the first piston housing section side wall apertures, and (ii) a second piston position wherein the piston is proximal to the first piston housing end and the piston is adjacent to some or all of the first piston housing section side wall apertures, the slide valve being adapted to close when the piston is moved from the first piston position to the second piston position and to open when the piston is moved from the second piston position to the first piston position; (d) a first biasing mechanism for urging the piston towards the first piston position; (e) sealing means for sealing the piston within the piston housing such that (i) liquid disposed in the first piston housing section cannot leak around the piston to the second piston housing section, and (ii) when the piston is moved adjacent to one of the plurality of first piston housing section side wall apertures, liquid disposed in the first piston housing section cannot leak around the piston and out through that first piston housing section side wall aperture; and (f) an external flow channel having a first end a second end, the first end of the external flow channel being in fluid tight communication with the first piston housing section via the first piston housing section side wall apertures, the second end of the external flow channel being in fluid tight communication with the second piston housing section via the second piston housing section side wall apertures; whereby, (i) when a liquid is disposed within the first piston housing section, the application of an axial force to the braking wheel causes the rotation of the at least one braking wheel and its braking wheel axis to thereby move the piston from the first piston position towards the second piston position, the slide valve is closed and the piston pressurizes liquid out of the first piston housing section via the first piston housing section side wall apertures, and into the second piston housing section via the second piston housing section side wall apertures, and (ii) when the axial force on the at least one braking wheel is released, the first biasing means urges the piston from the second piston position towards the first piston position, the slide valve is opened and liquid returns to the first piston housing section from the second piston housing section via the piston flow channel.

Thus, when a liquid is disposed within the first piston housing section, the application of an axial force to the at least one braking wheel causes the rotation of the at least one braking wheel to thereby moves the piston from the first piston position towards the second piston position, the slide valve is closed and the piston pressurizes liquid out of the first piston housing section via the first piston housing section side wall apertures, and into the second piston housing section via the second piston housing section side wall apertures. Then, when the axial force on the at least one braking wheel is released, the first biasing means urges the piston from the second piston position towards the first piston position, the slide valve is opened and liquid returns to the first piston housing section from the second piston housing section via the piston flow channel.

DESCRIPTION OF THE DRAWINGS

These and other features, aspects and advantages of the present invention will become better understood with reference to the following description, appended claims and accompanying drawings where:

DETAILED DESCRIPTION

The following discussion describes in detail one embodiment of the invention and several variations of that embodiment. This discussion should not be construed, however, as limiting the invention to those particular embodiments. Practitioners skilled in the art will recognize numerous other embodiments as well.

The invention is a braking mechanism 10 for a skate 12, such as an in-line roller skate, a traditional roller skate or an ice skate. The invention is especially applicable as a braking mechanism for an in-line roller skate 12 as illustrated in FIGS. 1–21.

Figure 1:
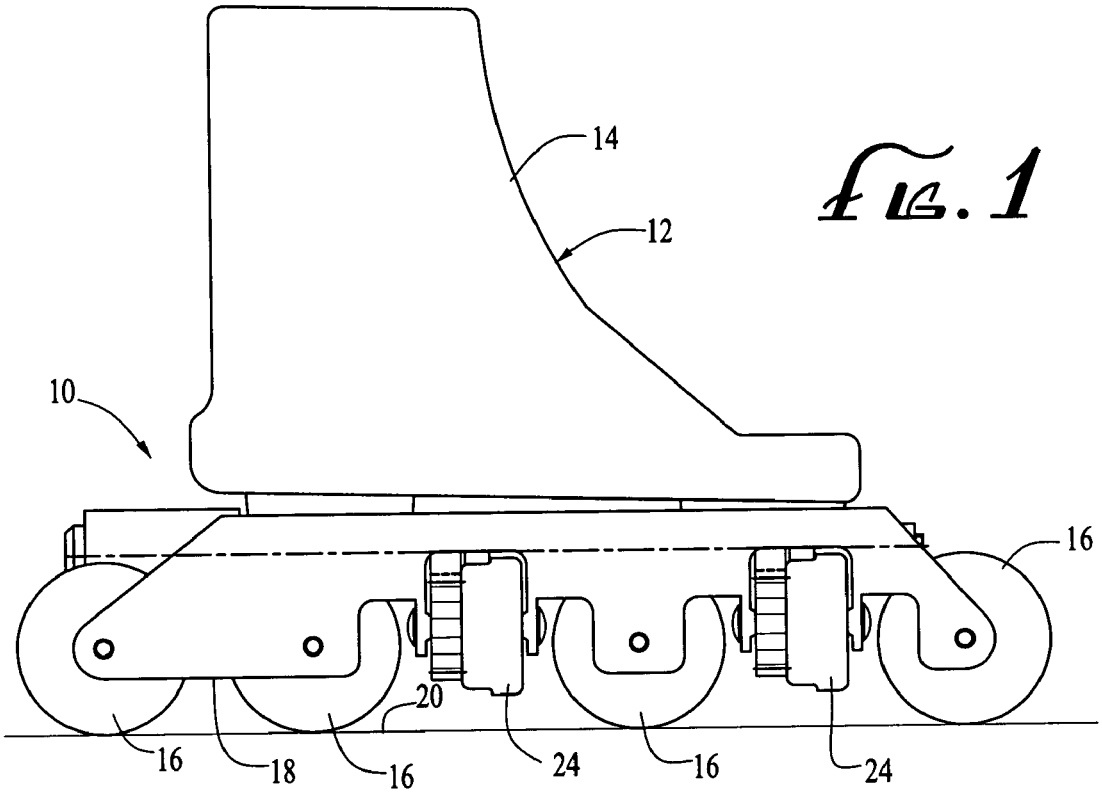
FIG. 1 is a side view of an in-line skate having a braking mechanism with features of the invention.
Figure 2:
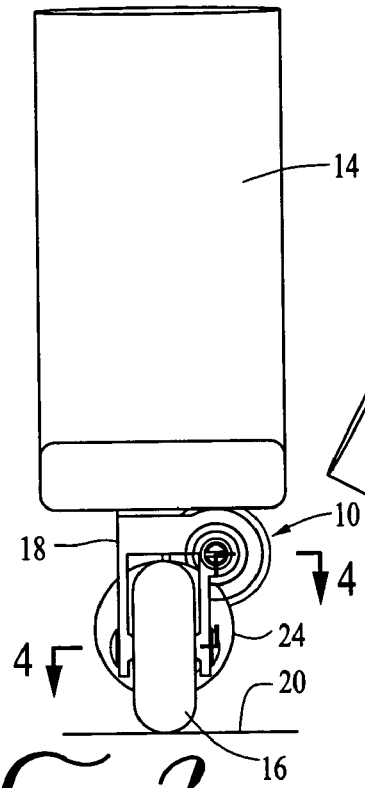
FIG. 2 is a front view of the in-line skate illustrated in FIG. 1, shown in a skating orientation.

FIGS. 1 and 2 illustrate an in-line roller 12 skate having a boot 14 and four in-line skating wheels 16. The skating wheels 16 are secured to a securing structure 18 which is attached to the boot 14. The four in-line skating wheels 16 are aligned in a single line. The lowermost portion of each of the in-line skating wheels 16 provides a base skating surface 20 having a base skating surface longitudinal axis 22.

The in-line skate 12 illustrated in FIG. 1 further comprises the braking mechanism 10 of the invention, disposed below the boot 14.

The braking mechanism 10 comprises at least one braking wheel 24. In the embodiment illustrated in the drawings, the at least one braking wheel 24 is provided by a pair of braking wheels 24. Each braking wheel 24 rotates about an axis 26. The axis 26 is disposed within a vertical plane. Typically, the vertical plane is directly aligned with the base skating surface longitudinal axis 22. However, this is not strictly necessary. Embodiments in which the vertical plane is "cocked" slightly with respect to the longitudinal axis 22 are also possible, such as embodiments in which the vertical plane intersects the base skating surface longitudinal axis 22 at an angle between about −20° and about +20°, most typically between about −5° and about +5°.

Figure 3:
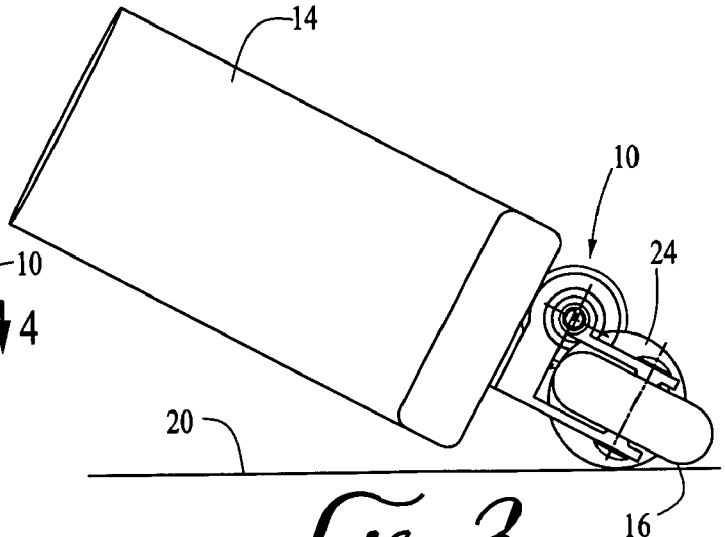
FIG. 3 is a front view of the skate illustrated in FIG. 1, shown in a braking orientation.

Each of the braking wheels 24 has an identical diameter, typically between about 65% of the diameter of the skating wheels 16 and about 85% of the diameter of the skating wheels 16. Each of the braking wheels 24 is disposed an equal distance above the base skating surface 20, typically between about 2 mm and about 20 mm above the base skating surface 20, and most typically between about 3 mm and about 16 mm above the base skating surface 20. The diameter of the braking wheels 24 and the distance at which the braking wheels 24 are disposed above the base skating surface 20 are chosen so that a skater can simultaneously engage the braking wheels 24 and disengage the skating wheels 16 by tilting the skate 12, as illustrated in FIG. 3.

Figure 4:
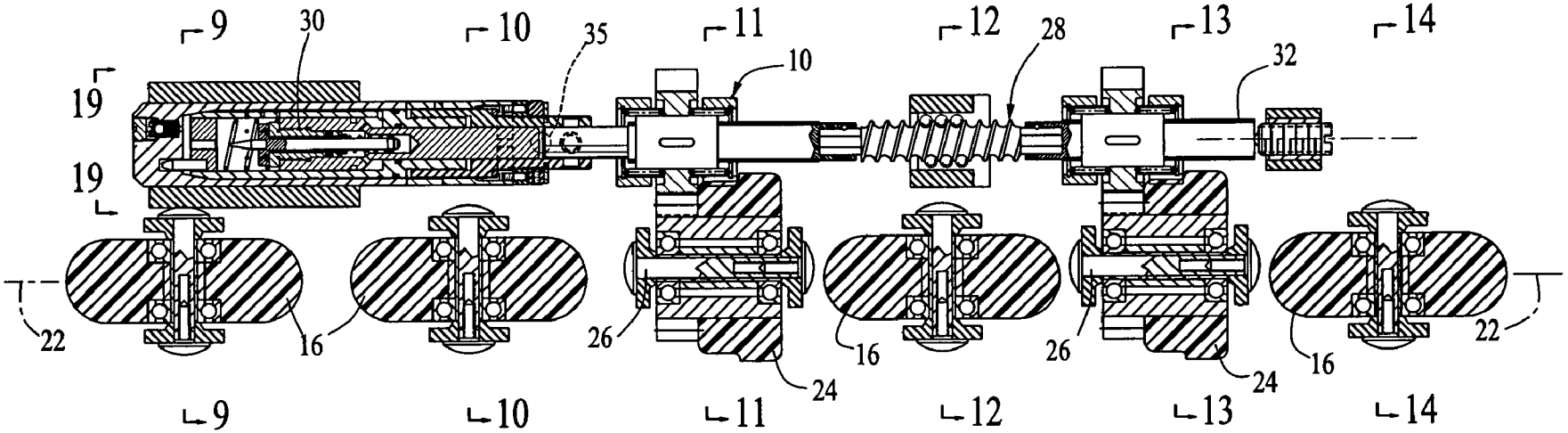
FIG. 4 is a cross-sectional view of the braking mechanism portion of the skate illustrated in FIG. 2, taken along line 4—4.
Figure 20:
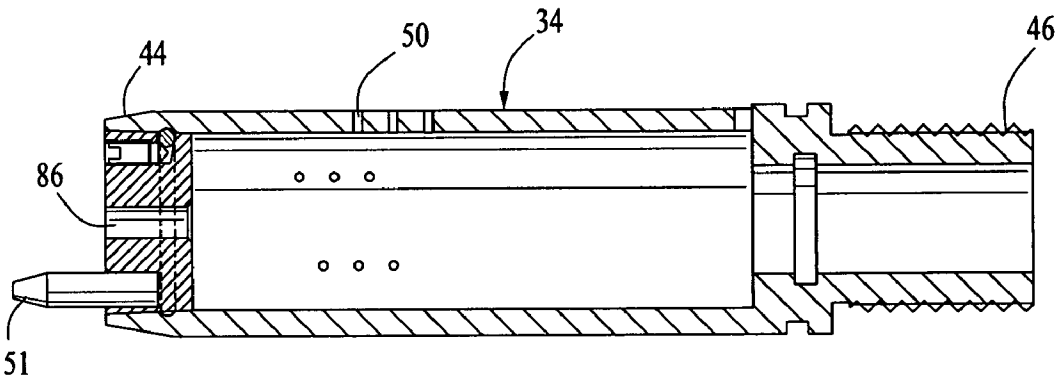
FIG. 20 is a detail cross-sectional side view of the forward end of the braking mechanism portion illustrated in FIG. 4.
Figure 19:
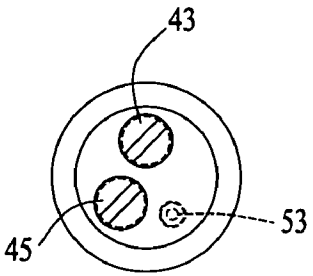
FIG. 19 is a detail end view of the braking mechanism illustrated in FIG. 4, taken along line 19—19.

As illustrated in FIG. 4, the braking mechanism 10 further comprises a braking piston 28 having a first piston end 30 and a second piston end 32. The first piston end 30 is secured within a piston housing 34 and the second piston end 32 is secured to one or more ball splines 94 (described below). The first piston end 30 is separated from the second piston end 32 by a thrust bearing, ball or ball bearing 35.

Figure 21:
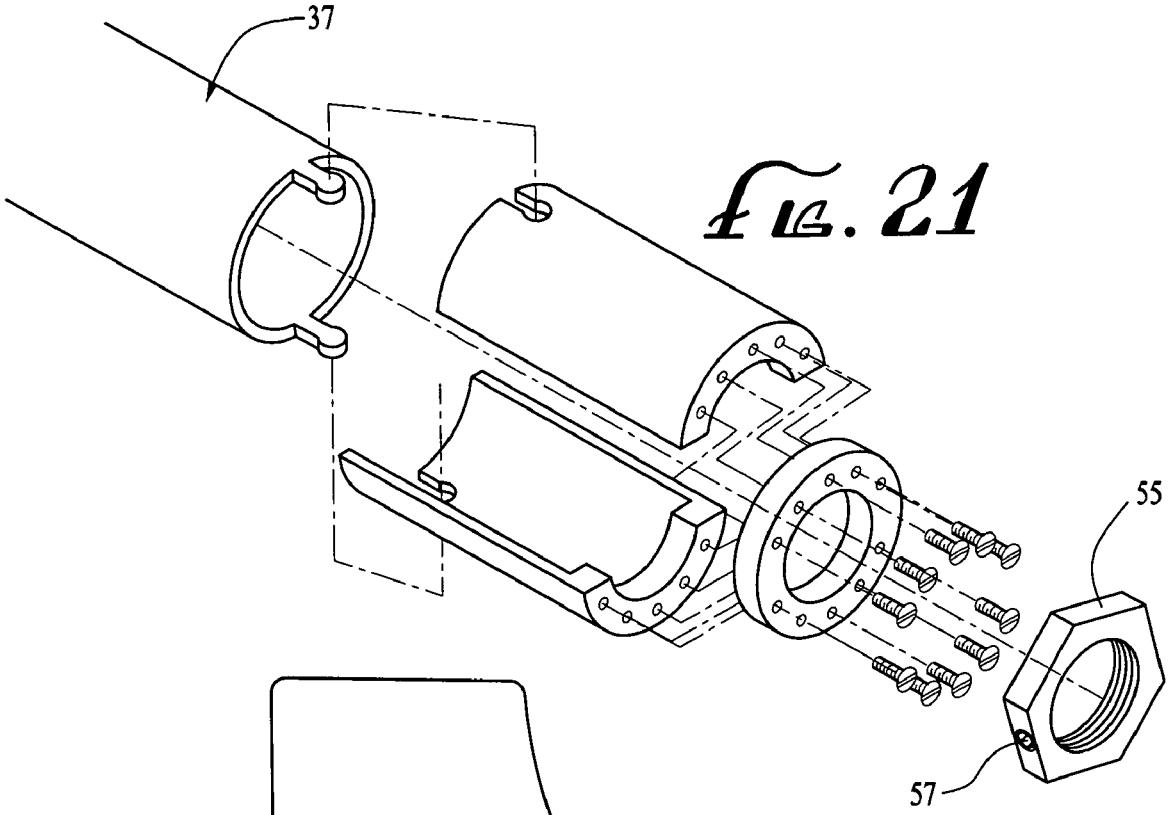
FIG. 21 is a detail exploded view of a portion of the braking mechanism illustrated in FIG. 4.

The piston housing 34 is disposed within an elongate body 37 having an elongate body first end 38 and an elongate body second end 40. The piston housing 34 is retained within the elongate body 37 by a retainer cylinder 41 and a retaining nut 55. To allow for the convenient installation of the piston housing 34 within the elongate body 37, the elongate body 37 is constructed from several assemblable elements as illustrated in FIG. 21. The elongate body 37 further comprises a fill port 43 for filling the piston housing 34 with a suitable brake fluid and a bleed port 45 for bleeding air from the elongate body 37 during the filling of brake fluid into the piston housing 34.

The piston housing 34 has piston housing side walls 42, a first piston housing end 44 and a second piston housing end 46. The piston housing 34 further comprises a first piston housing section 48 disposed proximal to the first piston housing end 44 and a second piston housing section 49 disposed distal to the first piston housing end 44. The first piston housing end 44 comprises a locator pin 51 sized and configured to be retained within a locator bore 53 within the first end 38 of the elongate body 37. The piston housing 34 is firmly retained within the elongate body 37 by the retainer cylinder 41 and the retaining nut 55 which is threaded over the retainer cylinder 41.

Figure 5:
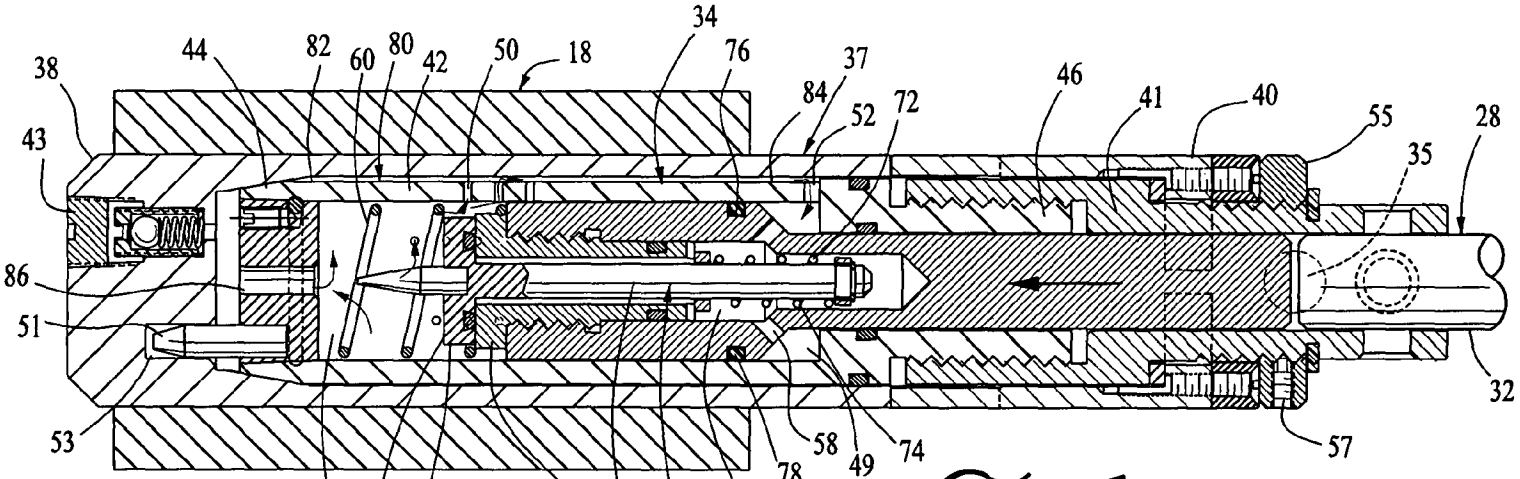
FIG. 5 is a cross-sectional detail view of the first end of the braking mechanism illustrated in FIG. 4, showing the first piston housing end disposed in abutment with the first end of the elongate body and showing the piston as it begins to move from the first piston position.

The piston housing 34 is disposed within the elongate body 37 such that the first piston housing end 44 is disposed proximal to the first end 38 of the elongate body 37. The specific location of the piston housing 34 within the elongate body 37 can be axially adjusted by backing off on the retaining nut 55 and rotating the retainer cylinder 41 in one direction or the other. Adjusting the specific location of the piston housing 34 with respect to the elongate body 37 affects the clearance between the first piston housing end 44 and the first end 38 of the elongate body 37. FIG. 5 illustrates a setting wherein the first piston housing end 44 is disposed in abutment to the first end 38 of the elongate body 37. In this setting, there is no clearance between the first piston housing end 44 and the first end 38 of the elongate body 37.

Figure 6:
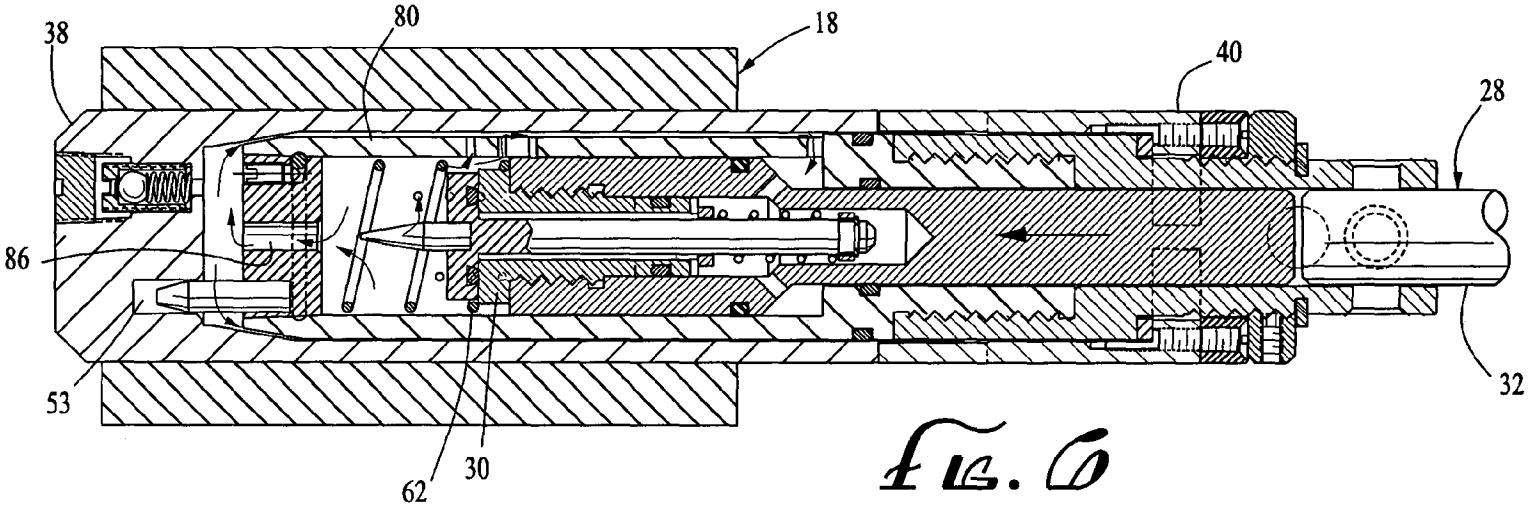
FIG. 6 is a cross-sectional detail view of the first end of the braking mechanism illustrated in FIG. 4, showing the first piston housing end disposed proximal to, but not in abutment with, the first end of the elongate body and showing the piston as it begins to move from the first piston position.
Figure 7:
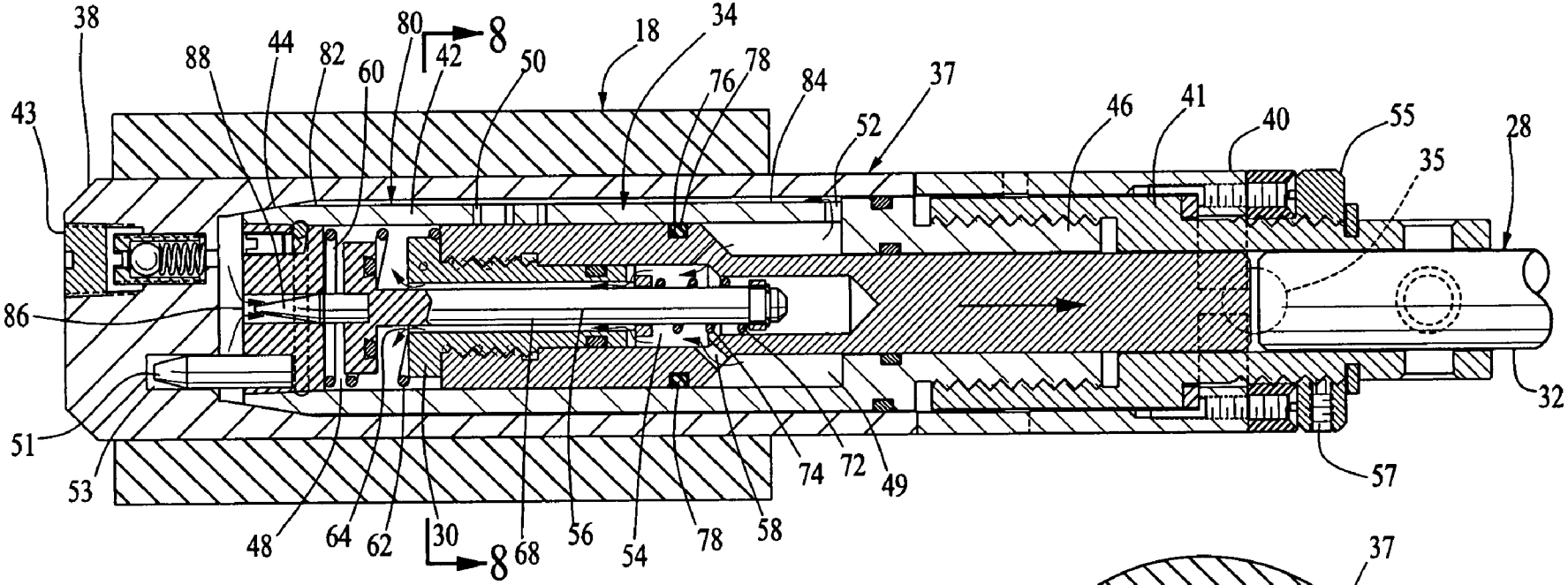
FIG. 7 a cross-sectional detail view of the first end of the braking mechanism illustrated in FIG. 4, showing the piston as it begins to move from the second piston position.
Figure 8:
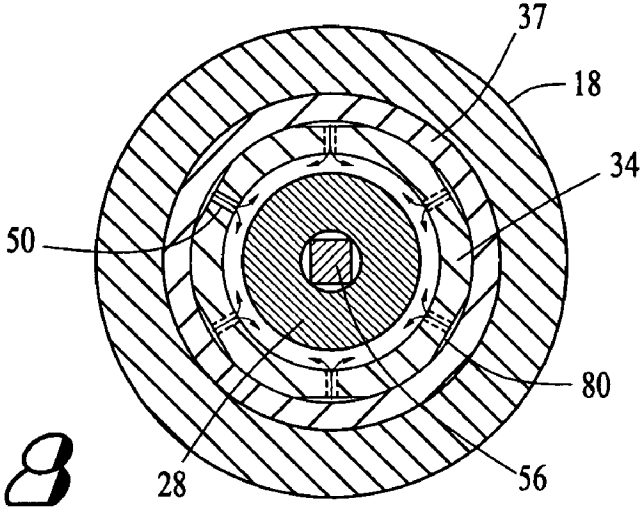
FIG. 8 is a cross-sectional view of the braking mechanism illustrated in-FIG. 7, taken along line 8—8.
Figure 9:
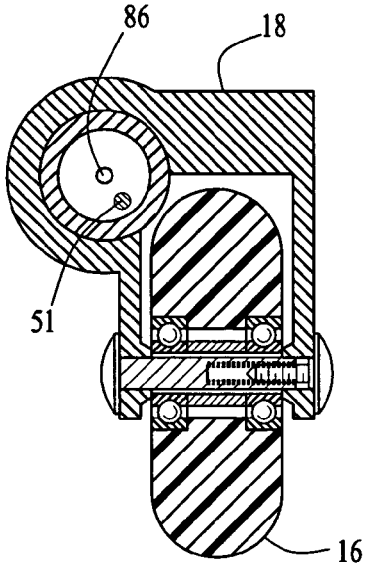
FIG. 9 is a cross-sectional view of the braking mechanism illustrated in FIG. 4, taken along line 9—9.
Figure 10:
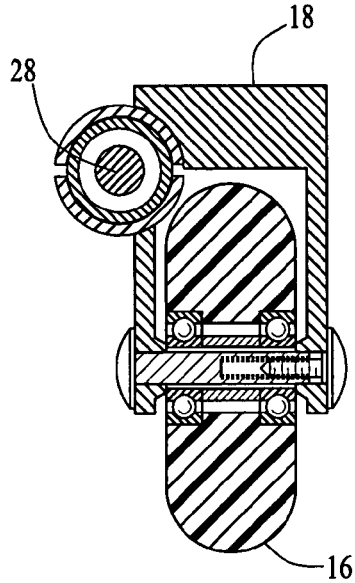
FIG. 10 is a cross-sectional view of the braking mechanism illustrated in FIG. 4, taken along line 10—10.
Figure 11:
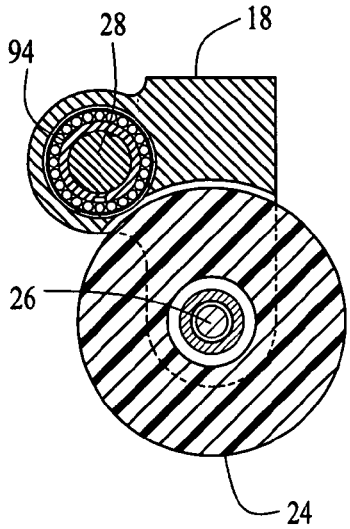
FIG. 11 is a cross-sectional view of the braking mechanism illustrated in FIG. 4, taken along line 11—11.
Figure 12:
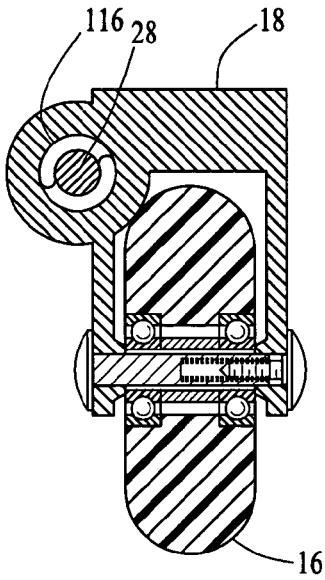
FIG. 12 is a cross-sectional view of the braking mechanism illustrated in FIG. 4, taken along line 12—12.
Figure 13:
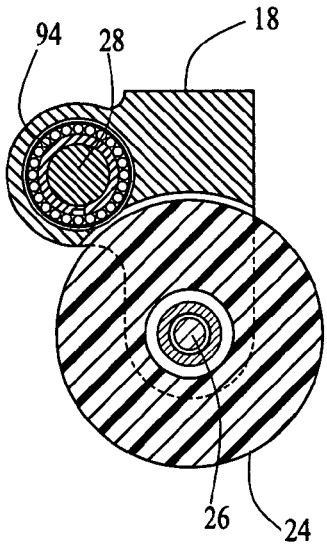
FIG. 13 is a cross-sectional view of the braking mechanism illustrated in FIG. 4, taken along line 13—13.
Figure 14:
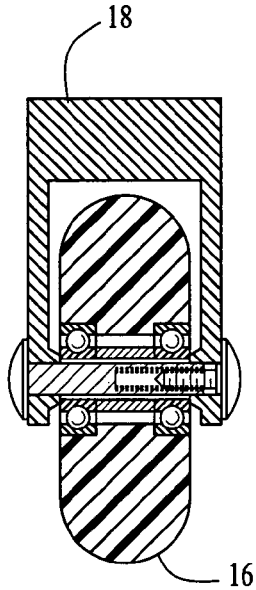
FIG. 14 is a cross-sectional view of the braking mechanism illustrated in FIG. 4, taken along line 14—14.

FIG. 6 illustrates a setting wherein the first piston housing end 44 is disposed proximal to, but not in abutment with, the first end 38 of the elongate body 37. In this setting, there is clearance between the first piston housing end 44 and the first end 38 of the elongate body 37. Once the piston housing 34 is specifically located within the elongate body 37, the retaining nut 55 is secured to the retainer cylinder 41 by tightening a set screw 57 disposed within the retaining nut 55.

As best understood with reference to FIGS. 5–8, the first piston housing section 48 defines a plurality of first piston housing section side wall apertures 50. The plurality of first piston housing section side wall apertures 50 are defined within the side walls 42 in the first piston housing section 48 at a variety of different distances from the first piston housing first end 44. Typically, each first piston housing side wall aperture 50 is round and has a diameter between about 0.5 mm and about 0.95 mm. In a typical embodiment, the side walls 42 in the first piston housing section 48 have between about 12 and about 24 first piston housing section side wall apertures 50.

The piston housing side walls 42 in the second piston housing section 49 comprise one or more second piston housing section side wall apertures 52. Typically, each second piston housing section side wall aperture 52 is round and has a diameter between about 1.2 mm and about 2.2 mm. In a typical embodiment, the side walls 42 in the second piston housing section 49 have between about 4 and about 10 second piston housing section side wall apertures 52.

Disposed within the piston housing 34 is the first end 30 of the piston 28. In the embodiments illustrated in the drawings, the piston 28 is movable within the piston housing 34 as will be described below.

The first end 30 of the piston 28 comprises an internal piston flow channel 54 for allowing the flow of liquids through the first end 30 of the piston 28. A slide valve 56 is disposed in the first end 30 of the piston 28 for controlling the flow of liquid from the piston flow channel 54 to the first piston housing section 48.

The piston 28 further comprises one or more piston inlet channels 58 for allowing the flow of liquid into the piston flow channel 54 from the second piston housing section 49. Typically, each of the piston inlet channels 58 is round and has a diameter between about 1.2 mm and about 2.2 mm. In a typical embodiment, between about 4 and about 8 piston inlet channels 58 are disposed within the piston 28.

A first biasing mechanism 60 is disposed within the piston housing 34 for urging the piston 28 towards the first piston position. In the embodiment illustrated in the drawings, the first biasing mechanism 60 is a coil spring 62.

The slide valve 56 is adapted to close when the piston 28 is moved from the first piston position to the second piston position and to open when the piston 28 is moved from the second piston position to the first piston position. In the embodiment illustrated in the drawings, the piston flow channel 54 has an open end 64 at the first end 30 of the piston 28. The slide valve 56 comprises a slidable plug 66 which is slidably disposed and retained within the piston flow channel 54. The slidable plug 66 comprises an elongate body 68 and an end cap 70. The slidable plug 66 is slidable between a first plug position wherein the end cap 70 covers the open end 64 of the piston flow channel 54 and a second plug position wherein the end cap 70 does not cover the open end 64 of the piston flow channel 54. In the embodiment illustrated in the drawings, a second biasing mechanism 72 is disposed within the piston flow channel 54 for urging the slidable plug 66 to the first plug position. The second biasing mechanism 72 is typically weaker than the first biasing mechanism 60. In the embodiment illustrated in the drawings, the second biasing method is a coil spring 74.

Sealing means 76 are provided in the braking mechanism 10 for sealing the piston 28 within the piston housing 34 such that liquid disposed in the first piston housing section 48 cannot leak around the piston 28 to the second piston housing section 49.

The sealing means 76 further assure that, when the piston 28 is moved adjacent to one of the plurality of first piston housing section side wall apertures 50, liquid disposed in the first piston housing section 48 cannot leak around the piston 28 and out through the first piston housing side wall section aperture 50.

In the embodiment illustrated in the drawings, the sealing means 76 can be provided by O-rings 78. One or more of the sealing means 76 may also be provided by close tolerances between adjoining surfaces. For example, an O-ring 78 can be replaced by close tolerances between the piston 28 and the piston housing 34, such as by constructing the piston 28 and the piston housing 34 with tolerances between about 0.005 mm and about 0.010 mm.

The braking mechanism 10 further comprises an external flow channel 80 disposed externally of the interior of the first piston housing section 48 and the second piston housing section 49. The external flow channel 80 has a first end 82 and a second end 84. The first end 82 of the external flow channel 80 is disposed in fluid tight communication with the first piston housing section 48 via the first piston housing section side wall apertures 50. The second end 84 of the external flow channel 80 is disposed in fluid tight communication with the second piston housing section 49 via the second piston housing section side wall apertures 52.

In the embodiment illustrated in the drawings, the first piston housing section 48 further defines a piston housing end aperture 86. In a typical embodiment, the piston housing end aperture 86 defines an open area between about 2 mm and about 4 mm. The piston housing end aperture 86 is capable of being disposed in fluid tight communication with the first end 82 of the external flow channel 80.

In the embodiment illustrated in the drawings, the piston 28 further comprises a tapered projection 88 which is aligned with the piston housing end aperture 86 such that, when the piston 28 is disposed in the second piston position, the tapered projection 88 is disposed within the piston housing end aperture 86 to reduce the open area of the piston housing end aperture 86. In one embodiment of the invention, the tapered projection 88 seals the piston housing end aperture 86 when the piston 28 is fully disposed in the second piston position.

The piston 28 is mechanically connected to each of the braking wheels 24 such that the rotation of the braking wheels 24 moves the piston 28 within the piston housing 34 between (i) a first piston housing position wherein the piston 28 is distal from the first piston housing end 44 and wherein the piston 28 is not adjacent to the first piston housing section side wall apertures 50, and (ii) a second piston housing position wherein the piston 28 is proximal to the first piston housing end 44 and the piston 28 is adjacent to some or all of the first piston housing section side wall apertures 50.

In the embodiment illustrated in the drawings, the piston 28 is mechanically connected to each of the braking wheels 24 in a way best understood from FIGS. 4 and 9–16. Each braking wheel 24 has a built-in braking wheel gear 90 disposed coaxially with the braking wheel 24. The braking wheel gear 90 meshes with a piston gear 92 which rotates about the piston 28. The piston gear 92 is operatively connected to the second end 32 of the piston 28 so that the rotation of the piston gear 92 rotates the second end 32 of the piston 28.

In the embodiment illustrated in the drawings, the piston gear 92 is operatively attached to the second end 32 of the piston 28 via a ball spline 94. The ball spline 94 is shown in detail in FIG. 17. The ball spline 94 comprises an inner cylinder 96 having an interior surface 98 and an exterior surface 100. The interior surface 98 of the inner cylinder 96 has three parallel longitudinal notches 102 which are sized and dimensioned to retain three parallel longitudinal ridges 104 disposed on the exterior surface of the second end 32 of the piston 28 in the vicinity of the ball spline 94. The exterior surface 100 of the inner cylinder 96 of the ball spline 94 defines a plurality of ball bearing races 106 wherein are disposed a plurality of ball bearings 108. The ball bearings 108 support the ball spline 94 on the second end 32 of the piston 28 and allow the piston 28 to freely travel in an axial direction while the ball spline 94 remains at a fixed location. The ball spline 94 also comprises an outer cylinder 110 which fully surrounds the ball bearing races 106. The outer cylinder 110 is affixed to the inner cylinder 96. The outer cylinder 110 defines a longitudinal key way 112. Disposed within the key way 112 is a key 114. The key 114 operatively connects the outer cylinder 110 of the ball spline 94 to the piston gear 92. Ball splines are available from a variety of manufacturers, including from THK Company of Tokyo, Japan. Thus, it can be seen that the rotation of the braking wheels 24 rotates the piston gear 92 (because of the cooperation between the braking wheel gear 90 and the piston gear 92), the rotation of the piston gear 92 causes the rotation of the ball spline 94 rotates the second end (via the connection of the piston gear 92 to the ball spline 94 with the key 114) and the rotation of the ball spline 94 rotates the second end 32 of the piston 28 (due to the rotation of the longitudinal notches 102 disposed within the interior surface 98 of the inner cylinder 96 against the longitudinal ridges 104 disposed on the exterior surface of the piston 28).

Figure 18:
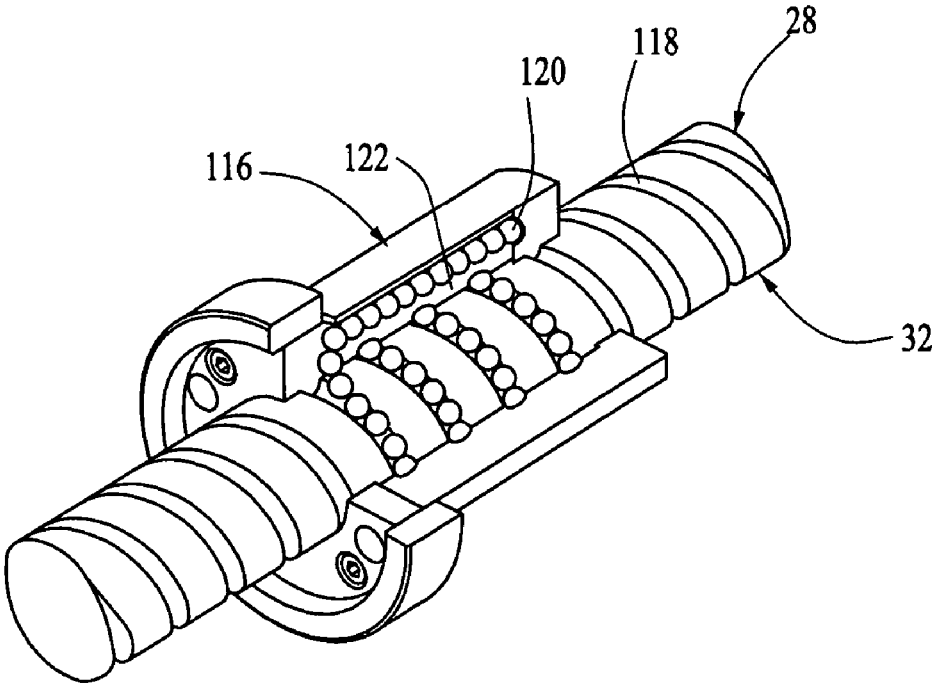
FIG. 18 is a detail isometric view of a ball screw useable in the invention.

When the rotation of the braking wheel 24 causes the rotation of the second end 32 of the piston 28 as described immediately above, the second end 32 of the piston 28 is caused to travel axially due to the rotation of the second end 32 within a ball screw 116 or similar device. A typical ball screw 116 is illustrated in FIG. 18. In the vicinity of the ball screw 116, the second end 32 of the piston 28 is provided with a helical groove 118. Within the ball screw 116, a plurality of ball bearings 120 acts as screw teeth within the helical groove 118 to translate the rotation of the second end 32 of the piston 28 into axial motion. As can be seen from FIG. 18, in a typical ball screw 116, the ball bearings 120 are caused to travel from one end of the ball screw 116 to the other, and are thereupon transferred to the opposite end of the ball screw 116 via an internal groove 122 disposed within the body of the ball screw 116. Ball screws are available from a variety of manufacturers, including from THK Company of Tokyo, Japan. Because of the interaction of the second end 32 of the piston 28 with the ball spline 94 and the ball screw 116, it can be seen that the rotation of the braking wheel 24 causes the piston 28 to travel towards the second piston position.

Figure 15:
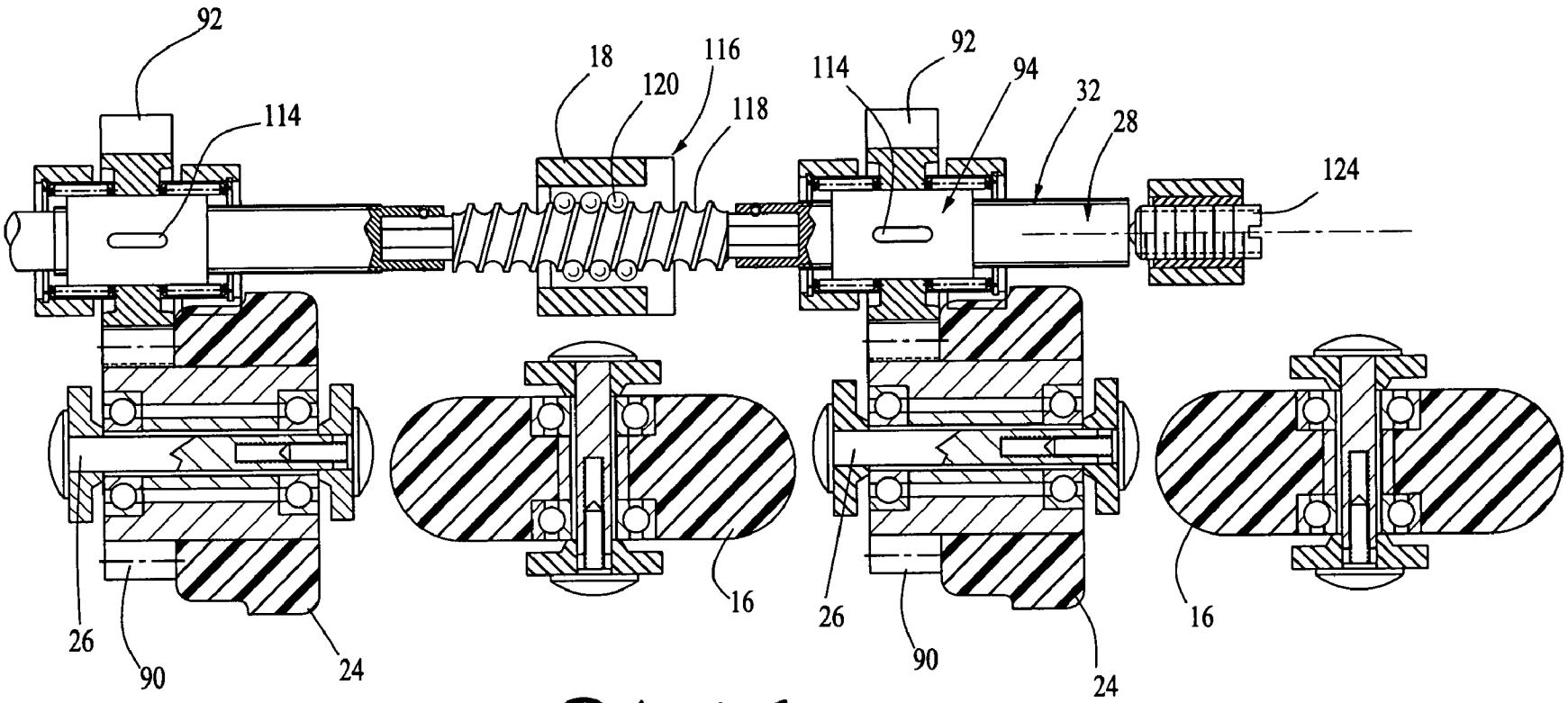
FIG. 15 is a detail cross-sectional view of the braking mechanism illustrated in FIG. 4, showing the piston initially disposed in a first position.
Figure 16:
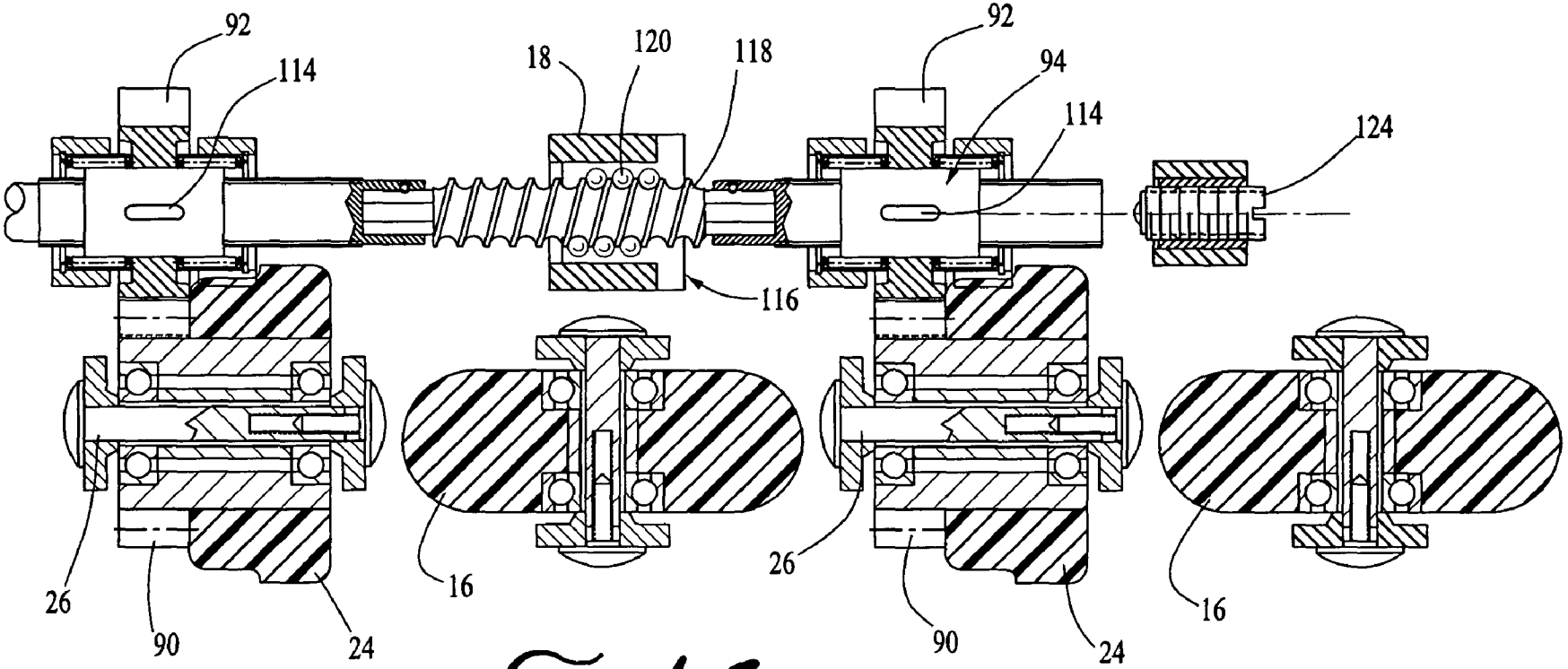
FIG. 16 is a detail cross-sectional view of the braking mechanism illustrated in FIG. 4, showing the piston initially disposed in a second position.
Figure 17:
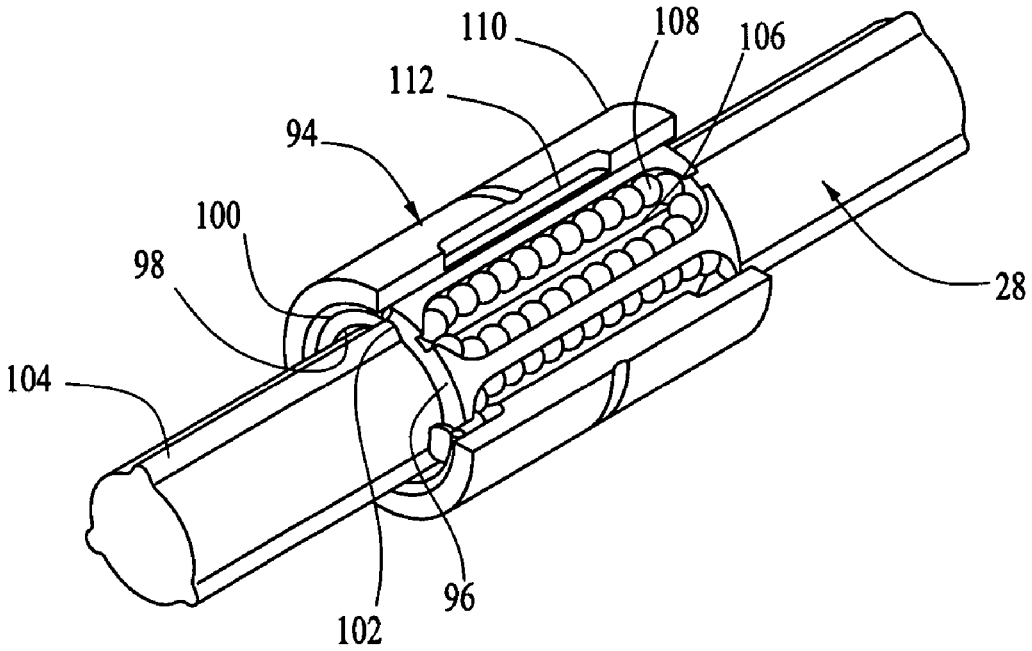
FIG. 17 is a detail isometric view of a ball spline useable in the invention.

As can be understood from FIGS. 15 and 16, the first piston position can be adjusted relative to the piston housing 34. This is accomplished by rotating an adjustment screw 124 disposed at the second end 32 of the piston 28. Adjusting the location of the first piston position affects the length of travel between the first piston position and the second piston position.

In operation, the user initially opens the fill port 43 and the bleed port 45 and fills the piston housing 34 with a suitable brake fluid such as DOT 3, marketed by First Brands Corporation of Danbury, Conn. The user then adjusts the specific location of the piston housing 34 within the elongate body 37 by rotating the retainer cylinder 41 and loosening the set screw 57, backing off the retaining nut 55 and sliding the piston housing 34 with respect to the elongate body 37. Once the piston housing 34 is properly located within the elongate body 37, the user tightens down on the retaining nut 55 and secures the retaining nut 55 with the set screw 57. The user next adjusts the location of the first piston position by adjusting the adjustment screw 124 in one direction the other. Once these two adjustments are accomplished, the user then places the skates 12 on his or her feet and commences to skate. When the user wishes to stop his or her forward motion, the user tilts one of the skates 12 as illustrated in FIG. 3. When one of the skates 12 is tilted as is illustrated in FIG. 3, the skating wheels 16 are raised up above the base skating surface 20 while the braking wheels 24 are lowered to the brake skating surface 20. By lowering the braking wheels 24 to the brake skating surface 20, the contact of the braking wheels 24 with the brake skating surface 20 causes the braking wheels 24 to rotate. The rotation of the braking wheels 24 is translated to the linear motion of the piston 28 via the braking wheel gear 90, the ball spline 94 and the ball screw 116. The linear motion of the piston 28 is from the first piston position towards the second piston position. As the piston travels from the first piston position towards the second piston position as illustrated in FIG. 5 or FIG. 6, braking fluid is displaced from the first piston housing section 48 to the external flow channel 80 via the first piston housing side wall apertures 50 (FIG. 5) or via both the first piston housing section side wall apertures 50 and the piston housing end aperture 86 (FIG. 6). The movement of the piston 28 towards the second piston position also displaces braking fluid from the external flow channel 80 into the second piston housing section 49 via the second piston housing section side wall apertures 52. Braking fluid within the second piston housing section 49 is displaced into the piston flow channel 54 via the piston inlet channels 58. As the piston 28 approaches the second piston position, the rate at which braking fluid is displaced from the first piston housing section 48 is markedly reduced because the piston 28 begins to seal off an increasing number of first piston housing section side wall apertures 50. As the rate of displacement of the braking fluid is decreased, the linear travel of the piston 28 is resisted by a pressure which builds up within the first piston housing section 48. This resistance to the travel of the piston 28 is translated to a resistance to the rotation of the braking wheels 24. The resistance to the rotation of the braking wheels 24 acts to brake the forward momentum of the skater. Once the skater returns to a normal skating operation wherein the braking wheels 24 are raised up above the base skating surface 20, the first biasing mechanism 60 urges the piston 28 to return to the first piston position. As this occurs (see FIG. 7), fluid pressure in the second piston housing section 49 opens the end cap 70 so that braking fluid can quickly be displaced from the second piston housing section 49 back into the first piston housing section 48.

Figure 22:
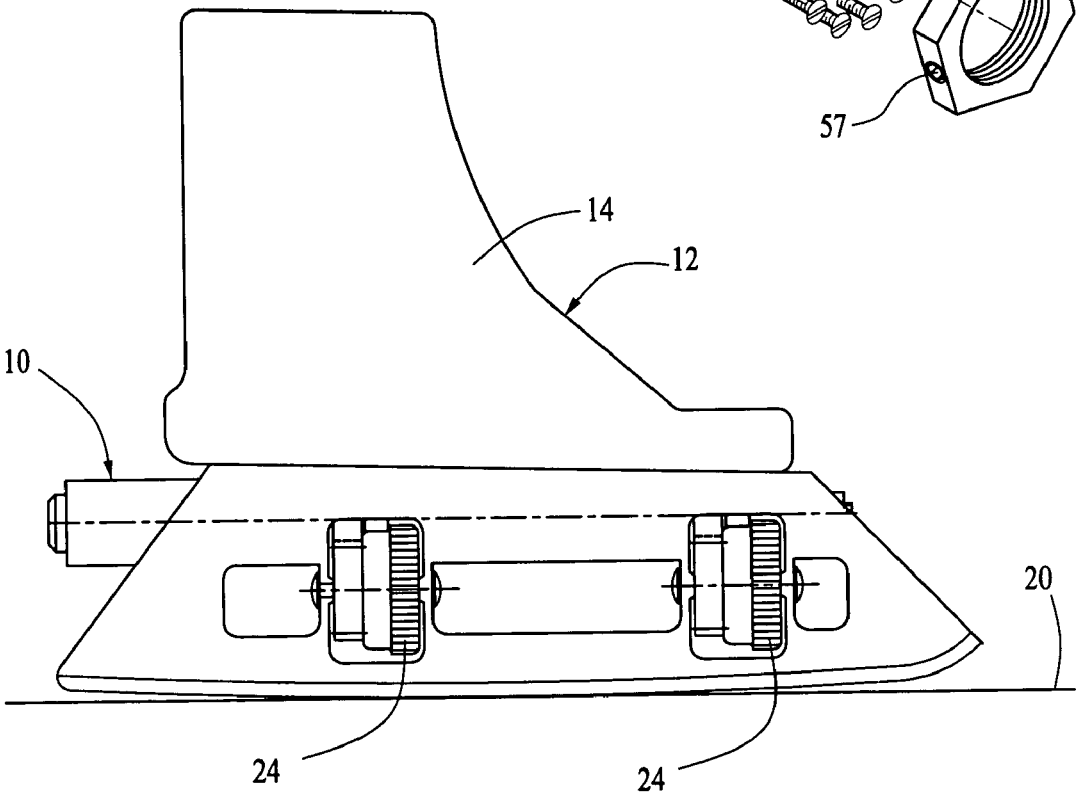
FIG. 22 is a side view of an ice skate having a braking mechanism with features of the invention.

As illustrated in FIG. 22, the braking mechanism of the invention can be used on an ice skate.

EXAMPLE

In one illustrative example of the invention, a boot 14 of a size 10 has skating wheels 16 with diameters of 72 mm. The diameters of the braking wheels 24 are 57 mm. The distance between the braking wheels 24 and the base skating surface 20 is 14.85 mm, the first piston housing section side wall apertures 50 have diameters of 0.79 mm and are 18 in number. The second piston housing section side wall apertures 52 have diameters of 1.6 mm and are 6 in number. The diameter of the piston housing end wall aperture 86 is 2.78 mm. The piston inlet channels 58 have a diameter of 1.6 mm and are 6 in number.

Having thus described the invention, it should be apparent that numerous structural modifications and adaptations may be resorted to without departing from the scope and fair meaning of the instant invention as set forth hereinabove and as described hereinbelow by the claims.

What is claimed is:

1. A braking mechanism for a skate, the skate having a base skating surface with a base skating surface longitudinal axis, the braking mechanism comprising:

(a) at least one braking wheel disposed above the base skating surface, the at least one braking wheel being rotatable about a braking wheel axis disposed in a vertical plane, the vertical plane intersecting the base skating surface longitudinal axis at an angle of between about −20° and about +20°;

(b) a piston housing having piston housing side walls, a first piston housing section proximal to a first piston housing end and a second piston housing section distal to the first piston housing end, the first piston housing section defining a plurality of first piston housing section side wall apertures, the first piston housing section side wall apertures being disposed at a plurality of different distances from the piston housing first end, the second piston housing section comprising one or more second piston housing section side wall apertures;

(c) a piston disposed within the piston housing, the piston having a first end and a second end, the first end comprising an internal piston flow channel and a slide valve disposed in the first end of the piston for controlling the flow of liquid from the piston flow channel to the first piston housing section, the piston further comprising one or more piston inlet channels for allowing the flow of liquid into the piston flow channel from the second piston housing section, the piston being mechanically connected to the at least one braking wheel such that the rotation of the at least one braking wheel moves the piston within the piston housing between (i) a first piston position wherein the piston is distal from the first piston housing end and wherein the piston is not adjacent to the first piston housing section side wall apertures, and (ii) a second piston position wherein the piston is proximal to the first piston housing end and the piston is adjacent to some or all of the first piston housing section side wall apertures, the slide valve being adapted to close when the piston is moved from the first piston position to the second piston position and to open when the piston is moved from the second piston position to the first piston position;

(d) a first biasing mechanism for urging the piston towards the first piston position;

(e) sealing means for sealing the piston within the piston housing such that (i) liquid disposed in the first piston housing section cannot leak around the piston to the second piston housing section, and (ii) when the piston is moved adjacent to one of the plurality of first piston housing section side wall apertures, liquid disposed in the first piston housing section cannot leak around the piston and out through that first piston housing section side wall aperture; and (f) an external flow channel having a first end a second end, the first end of the external flow channel being in fluid tight communication with the first piston housing section via the first piston housing section side wall apertures, the second end of the external flow channel being in fluid tight communication with the second piston housing section via the second piston housing section side wall apertures;

whereby, (i) when a liquid is disposed within the first piston housing section, the application of an axial force to the braking wheel causes the rotation of the at least one braking wheel and its braking wheel axis to thereby move the piston from the first piston position towards the second piston position, the slide valve is closed and the piston pressurizes liquid out of the first piston housing section via the first piston housing section side wall apertures, and into the second piston housing section via the second piston housing section side wall apertures, and (ii) when the axial force on the at least one braking wheel is released, the first biasing means urges the piston from the second piston position towards the first piston position, the slide valve is opened and liquid returns to the first piston housing section from the second piston housing section via the piston flow channel.

2. The braking mechanism of claim 1 wherein the at least one braking wheel is rotatable about a braking wheel axis disposed in a vertical plane, the vertical plane intersecting the base skating surface longitudinal axis at an angle of between about −50° and about +50°.

3. The braking mechanism of claim 1 wherein the first piston housing end defines a piston housing end aperture and the first end of the external flow channel is in fluid tight communication with the piston housing end aperture.

4. The braking mechanism of claim 3 wherein the first end of the piston further comprises a tapered projection aligned with the piston housing end aperture such that, when the piston is disposed in the second piston position, the tapered projection is disposed within the piston housing end aperture.

5. The braking mechanism of claim 4 wherein, when the piston is disposed in the second piston position, the tapered projection seals closed the piston housing end aperture.

6. The braking mechanism of claim 3 wherein the piston housing is disposed coaxially within an elongate body, the elongate body having a first end and a second end, the first end of the piston housing being disposed proximate to the first end of the elongate body, the piston housing being axially moveable with respect to the elongate body between (i) a first piston housing position wherein the first end of the piston housing is not in abutment with the elongate body such that a channel is defined between the piston housing and the elongate body which connects the piston housing end aperture in fluid tight communication with the external flow channel and (ii) a second piston housing position wherein the first end of the piston housing is in abutment with the elongate body and no flow channel exists connecting the piston housing end aperture to the external flow channel.

7. The braking mechanism of claim 1 wherein the piston flow channel has an open end at the first end of the piston and wherein the slide valve comprises a slidable plug slidably disposed and retained within the piston flow channel, the slidable plug comprising an elongate body and an end cap, the slidable plug being slidable between a first plug position wherein the end cap covers the open end of the piston flow channel and a second plug position wherein the end cap does not cover the open end of the piston flow channel.

8. The braking mechanism of claim 7 further comprising a second biasing mechanism for urging the slidable plug to the first plug position, the second biasing mechanism being weaker than the first biasing mechanism.

9. The braking mechanism of claim 7 wherein the first biasing mechanism is a coil spring disposed within the first piston housing section and the second biasing mechanism is a coil spring disposed within the piston flow channel.

10. The braking mechanism of claim 1 wherein the first piston position can be adjusted by axially moving the second end of the piston.

11. The braking mechanism of claim 1 wherein the at least one braking wheel comprises a plurality of braking wheels.

12. The braking mechanism of claim 1 wherein the at least one braking wheel comprises two braking wheels.

13. A braking mechanism for a skate, the skate having a base skating surface with a base skating surface longitudinal axis, the braking mechanism comprising:

(a) at least one braking wheel disposed above the base skating surface, the at least one braking wheel being rotatable about a braking wheel axis disposed in a vertical plane, the vertical plane intersecting the base skating surface longitudinal axis at an angle of between about −5° and about +5°;

(b) a piston housing having piston housing side walls, a first piston housing section proximal to a first piston housing end and a second piston housing section distal to the first piston housing end, the first piston housing section defining a plurality of first piston housing section side wall apertures, the first piston housing section side wall apertures being disposed at a plurality of different distances from the piston housing first end, the second piston housing section comprising one or more second piston housing section side wall apertures, the first piston housing end also defining a piston housing end aperture;

(c) a piston disposed within the piston housing, the piston being mechanically connected to the at least one braking wheel such that the rotation of the at least one braking wheel moves the piston within the piston housing between (i) a first piston position wherein the piston is distal from the first piston housing end and wherein the piston is not adjacent to the first piston housing section side wall apertures, and (ii) a second piston position wherein the piston is proximal to the first piston housing end and the piston is adjacent to some or all of the first piston housing section side wall apertures, the piston having a first end and a second end, the first end comprising an internal piston flow channel and a slide valve disposed in the first end of the piston for controlling the flow of liquid from the piston flow channel to the first piston housing section, the piston further comprising one or more piston inlet channels for allowing the flow of liquid into the piston flow channel from the second piston housing section, the piston flow channel having an open end at the first end of the piston and wherein the slide valve comprises a slidable plug slidably disposed and retained within the piston flow channel, the slidable plug comprising an elongate body and an end cap, the slidable plug being slidable between a first plug position wherein the end cap covers the open end of the piston flow channel and a second plug position wherein the end cap does not cover the open end of the piston flow channel, the end cap comprising a tapered projection aligned with the piston housing end aperture such that, when the piston is disposed in the second piston position, the tapered projection is disposed within the piston housing end aperture, so that when the piston is disposed in the second piston position, the tapered projection seals closed the piston housing end aperture, the slide valve, being adapted to close when the piston is moved from the first piston position to the second piston position and to open when the piston is moved from the second piston position to the first piston position;

(d) a slidable plug coil spring disposed within the internal piston flow channel for urging the slidable plug to the first plug position;

(e) a piston coil spring for urging the piston towards the first piston position, the piston coil spring being stronger than the slidable plug coil spring;

(f) sealing means for sealing the piston within the piston housing such that (i) liquid disposed in the first piston housing section cannot leak around the piston to the second piston housing section, and (ii) when the piston is moved adjacent to one of the plurality of first piston housing section side wall apertures, liquid disposed in the first piston housing section cannot leak around the piston and out through that first piston housing section side wall aperture; and (g) an external flow channel having a first end a second end, the first end of the external flow channel being in fluid tight communication with the first piston housing section via the first piston housing section side wall apertures and the first piston housing end aperture, the second end of the external flow channel being in fluid tight communication with the second piston housing section via the second piston housing section side wall apertures;

whereby, (i) when a liquid is disposed within the first piston housing section, the application of an axial force to the braking wheel causes the rotation of the at least one braking wheel and its braking wheel axis to thereby move the piston from the first piston position towards the second piston position, the slide valve is closed and the piston pressurizes liquid out of the first piston housing section via the first piston housing section side wall apertures, and into the second piston housing section via the second piston housing section side wall apertures, and (ii) when the axial force on the at least one braking wheel is released, the piston coil spring urges the piston from the second piston position towards the first piston position, the slide valve is opened and liquid returns to the first piston housing section from the second piston housing section via the piston flow channel.

14. The braking mechanism of claim 13 wherein the first piston position can be adjusted by axially moving the second end of the piston.

15. The braking mechanism of claim 13 wherein the piston housing is disposed coaxially within an elongate body, the elongate body having a first end and a second end, the first end of the piston housing being disposed proximate to the first end of the elongate body, the piston housing being axially moveable with respect to the elongate body between (i) a first piston housing position wherein the first end of the piston housing is not in abutment with the elongate body such that a channel is defined between the piston housing and the elongate body which connects the piston housing end aperture in fluid tight communication with the external flow channel and (ii) a second piston housing position wherein the first end of the piston housing is in abutment with the elongate body and no flow channel exists connecting the piston housing end aperture to the external flow channel.

16. A skate having a base skating surface with a base skating surface longitudinal axis, the skate comprising:

(a) a skate boot; and (b) a braking mechanism attached to the boot, the braking mechanism comprising:

(i) at least one braking wheel disposed above the base skating surface, the at least one braking wheel being rotatable about a braking wheel axis disposed in a vertical plane, the vertical plane intersecting the base skating surface longitudinal axis at an angle between about −5° and about +5°, the at least one braking wheel being affixed to the braking wheel axis;

(ii) a piston housing having piston housing side walls, a first piston housing section proximal to a first piston housing end and a second piston housing section distal to the first piston housing end, the first piston housing section defining a plurality of first piston housing section side wall apertures, the first piston housing section side wall apertures being disposed at a plurality of different distances from the piston housing first end, the second piston housing section comprising one or more second piston housing section side wall apertures;

(iii) a piston disposed within the piston housing, the piston having a first end and a second end, the first end comprising an internal piston flow channel and a slide valve disposed in the first end of the piston for controlling the flow of liquid from the piston flow channel to the first piston housing section, the piston further comprising one or more piston inlet channels for allowing the flow of liquid into the piston flow channel from the second piston housing section, the piston being mechanically connected to the braking wheel such that the rotation of the at least one braking wheel moves the piston within the piston housing between (A) a first piston position wherein the piston is distal from the first piston housing end and wherein the piston is not adjacent to the first piston housing section side wall apertures, and (B) a second piston position wherein the piston is proximal to the first piston housing end and the piston is adjacent to some or all of the first piston housing section side wall apertures, the slide valve being adapted to close when the piston is moved from the first piston position to the second piston position and to open when the piston is moved from the second piston position to the first piston position;

(vi) a first biasing mechanism for urging the piston towards the first piston position;

(v) sealing means for sealing the piston within the piston housing such that (A) liquid disposed in the first piston housing section cannot leak around the piston to the second piston housing section, and (B) when the piston is moved adjacent to one of the plurality of first piston housing section side wall apertures, liquid disposed in the first piston housing section cannot leak around the piston and out through that first piston housing section side wall aperture; and (vi) an external flow channel having a first end a second end, the first end of the external flow channel being in fluid tight communication with the first piston housing section via the first piston housing section side wall apertures, the second end of the external flow channel being in fluid tight communication with the second piston housing section via the second piston housing section side wall apertures.

17. The skate of claim 16 wherein the skate is an in-line roller skate.

18. The skate of claim 16 wherein the skate is an ice skate.

* * * * *